US008205943B2

(12) United States Patent
Zhong

(10) Patent No.: US 8,205,943 B2
(45) Date of Patent: Jun. 26, 2012

(54) FOLDABLE ROCKING CHAIR

(75) Inventor: Zhi-Ren Zhong, Hong Kong (CN)

(73) Assignee: Wonderland Nursery Goods Co., Ltd, Taipei (TW)

( * ) Notice: Subject to any disclaimer, the term of this patent is extended or adjusted under 35 U.S.C. 154(b) by 146 days.

(21) Appl. No.: 12/805,466

(22) Filed: Aug. 2, 2010

(65) Prior Publication Data

US 2011/0031783 A1 Feb. 10, 2011

(30) Foreign Application Priority Data

Aug. 4, 2009 (CN) ..... 2009 1 0159039

(51) Int. Cl.
*A47D 13/10* (2006.01)
*A47C 3/02* (2006.01)
*A47C 3/03* (2006.01)

(52) U.S. Cl. .... 297/274; 297/32; 297/258.1; 297/270.2; 297/271.6

(58) Field of Classification Search ..... 297/32, 297/258.1, 270.2, 271.6, 274
See application file for complete search history.

(56) References Cited

U.S. PATENT DOCUMENTS 4,718,715 A * 1/1988 Ho ..... 297/32
5,178,438 A * 1/1993 Beger ..... 297/271.6
5,868,459 A * 2/1999 Welsh, Jr. ..... 297/32
6,174,028 B1 * 1/2001 Yang et al. ..... 297/258.1
6,361,106 B1 * 3/2002 Huang ..... 297/32
6,540,292 B2 * 4/2003 Darling et al. ..... 297/271.6 X
6,679,779 B2 * 1/2004 Tai et al. ..... 297/33 X
6,682,137 B2 * 1/2004 Hsia ..... 297/32
6,682,148 B1 * 1/2004 Chen ..... 297/440.24
6,811,217 B2 * 11/2004 Kane et al. ..... 297/270.2
6,877,802 B2 * 4/2005 Christensen et al. ..... 297/16.1
7,255,393 B2 * 8/2007 Flanagan ..... 297/274 X
7,506,922 B2 * 3/2009 Schulte et al. ..... 297/270.2 X
7,621,592 B1 * 11/2009 Flannery ..... 297/271.6 X
8,038,207 B2 * 10/2011 Flannery ..... 297/174 CS
8,079,639 B2 * 12/2011 Zeng et al. ..... 297/270.1 X

* cited by examiner

*Primary Examiner* — Rodney B White

(74) *Attorney, Agent, or Firm* — Davidson Berquist Jackson & Gowdey, LLP

(57) ABSTRACT

A foldable rocking chair includes a base having a curved rocking portion, a first adjustment rod pivotally connected to the base, a seat having a front end pivotally connected to a front end of the base, a second adjustment rod pivotally connected to the seat, and a folding joint for interconnecting the first and second adjustment rods. The seat is adjustable relative to the base between a fully unfolded position and a folded position. The folding joint is constructed so as to allow pivoting movement of the seat from the folded position to the fully unfolded position, while preventing pivoting movement of the seat from the fully unfolded position to the folded position when no external force is applied the folding joint.

22 Claims, 16 Drawing Sheets

FOLDABLE ROCKING CHAIR

CROSS-REFERENCE TO RELATED APPLICATION

This application claims priority of Chinese Application No. 200910159039.7, filed on Aug. 4, 2009.

BACKGROUND OF THE INVENTION

1. Field of the Invention

This invention relates to a rocking chair, and more particularly to a foldable rocking chair.

2. Description of the Related Art

Referring to FIGS. 1, 2, and 3, a conventional foldable rocking chair 200 can be folded by operating two locking units 260 disposed on a back frame tube 230. Each of the locking units 260 includes an adjusting rod 264 pivotable between a locking position and a non-locking position that is shown in FIG. 2. In the locking position, a free end of the adjusting rod 264 abuts against a side frame 220 to allow an outer housing 261 to contact the side frame 220, such that ratchet teeth 262 of the outer housing 261 engage ratchet teeth 221 of the side frame 220, thereby preventing rotation of the back frame tube 230 relative to the side frame 220. In the non-locking position, the free end of the adjusting rod 264 is spaced apart from the side frame 220, so that the outer housing 261 is biased by a spring 263 to separate from the side frame 220 to thereby disengage the ratchet teeth 262 of the outer housing 261 from the ratchet teeth 221 of the side frame 220, thus allowing for rotation of the back frame tube 230 relative to the side frame 220 for an angle adjustment or folding operation.

When angle adjustment is desired, it is necessary to pivot each of the adjusting rods 264 to the non-locking position. After relative position between the back frame tube 230 and the side frames 220 is adjusted, each of the adjusting rods 264 must be returned to the locking position. As such, the conventional foldable rocking chair is not convenient to use. Furthermore, the locking units 260 are disposed respectively on two sides of the rocking chair 200, thereby further resulting in inconvenience during operation of the locking units 260.

SUMMARY OF THE INVENTION

The object of this invention is to provide a foldable rocking chair that can overcome the above-mentioned disadvantages associated with the prior art.

According to this invention, a foldable rocking chair includes a base having a curved rocking portion, a first adjustment rod pivotally connected to the base, a seat having a front end pivotally connected to a front end of the base, a second adjustment rod pivotally connected to the seat, and a folding joint for interconnecting the first and second adjustment rods. The seat is adjustable relative to the base between a fully unfolded position and a folded position. The folding joint is constructed so as to allow pivoting movement of the seat from the folded position to the fully unfolded position, while preventing pivoting movement of the seat from the fully unfolded position to the folded position when no external force is applied to the folding joint. As such, to adjust the seat from the folded position to the fully unfolded position, it is not necessary to operate any locking device, thereby resulting in convenience for use of the rocking chair.

In one embodiment, the folding joint includes a plurality of components interconnected and arranged along a rotating axis, and including:

a first rotating housing connected to the first adjustment rod and having an inner surface formed with a plurality of first rib units projecting toward the rotating axis;

a second rotating housing connected to the second adjustment rod and having an inner surface formed with a plurality of second rib units projecting toward the rotating axis;

a gear disposed between the first and second rotating housings and having an annular outer peripheral surface formed with a plurality of projecting teeth spaced apart from each other to define a plurality of keyways, the first rib units engaging the keyways, respectively, so as to prevent rotation of the gear relative to the first rotating housing; and a biasing spring disposed between the first rotating housing and the gear so as to bias the gear toward the second rotating housing to thereby engage the second rib units with the keyways, respectively, thus locking the first and second rotating housings relative to each other.

The folding joint is operable to allow for rotation of the first and second rotating housings relative to each other.

As such, the seat can be pivoted from the fully unfolded position to the folded position by operating only the folding joint. In other words, the folded rocking chair is convenient to operate.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
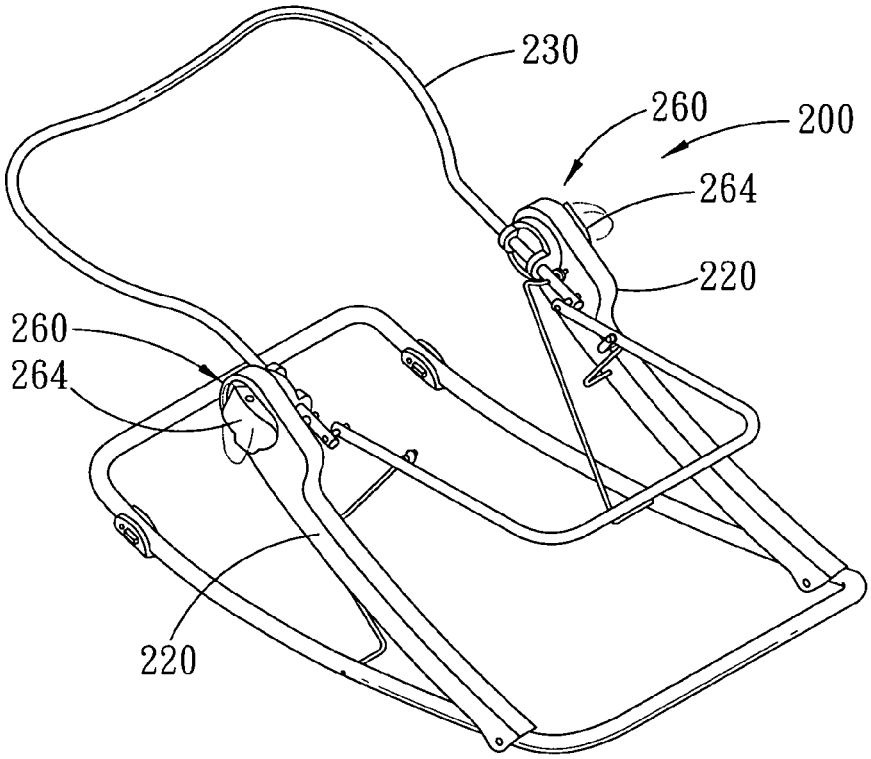
FIG. 1 PRIOR ART
FIG. 1 is a perspective view of a conventional foldable rocking chair.
Figure 2:
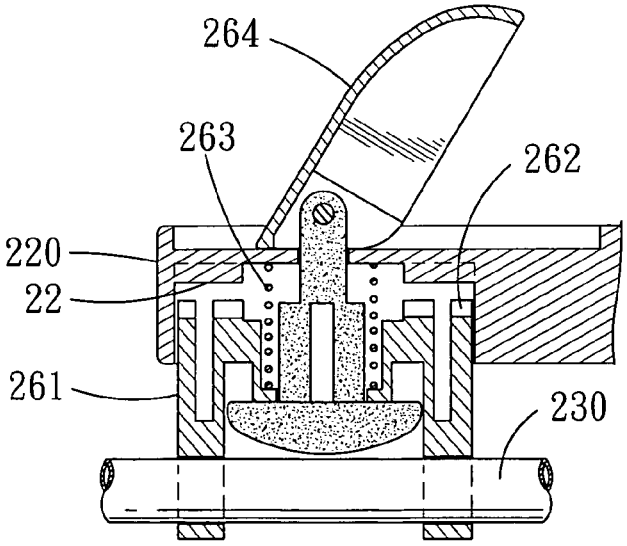
FIG. 2 PRIOR ART
FIG. 2 is a sectional view of a locking unit of the conventional foldable rocking chair when in a non-locking position.
Figure 3:
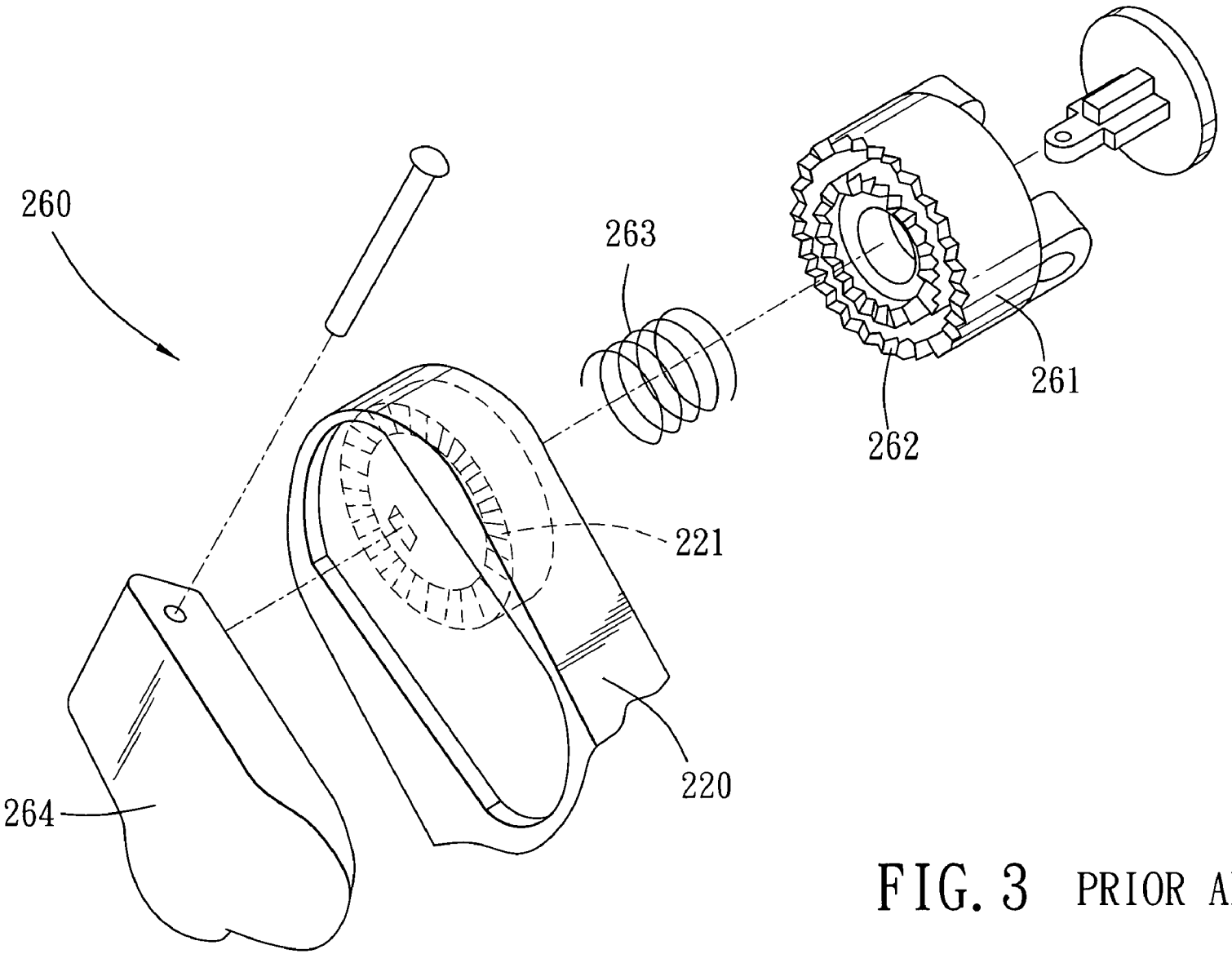
FIG. 3 PRIOR ART
FIG. 3 is an exploded perspective view of the locking unit of the conventional foldable rocking chair.

Before the present invention is described in greater detail in connection with the preferred embodiments, it should be noted that similar elements and structures are designated by like reference numerals throughout the entire disclosure.

Figure 4:
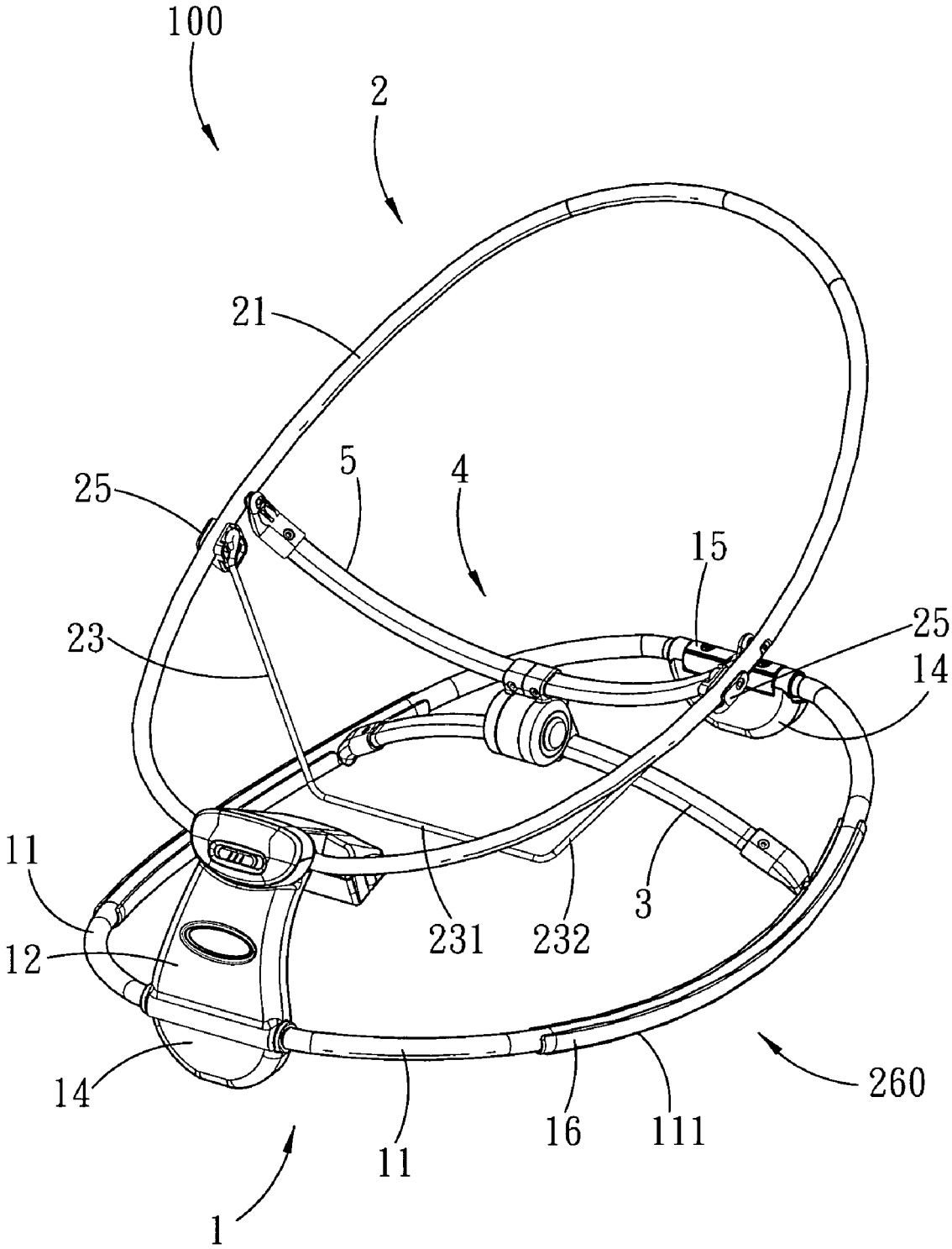
FIG. 4 is a perspective view of the preferred embodiment of a foldable rocking chair according to this invention.
Figure 5:
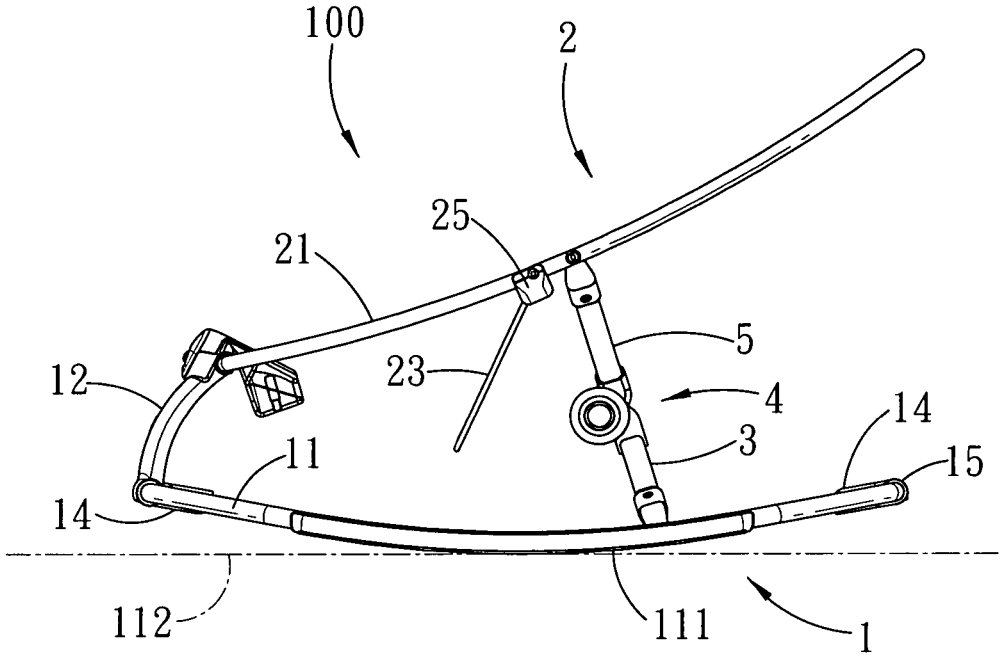
FIG. 5 is a schematic side view of the preferred embodiment, illustrating a seat in a fully unfolded position.

Referring to FIGS. 4 and 5, the preferred embodiment of a foldable rocking chair 100 according to this invention includes a base 1, a seat 2, a first adjustment rod 3, a second adjustment rod 5, and a folding joint 4.

The base 1 includes two curved bottom tubes 11, a first support seat 12, a second support seat 15, and two anti-slip members 16. In this embodiment, the curved bottom tubes 11 cooperate to form a looped structure, such as an ellipse. The base 1 has a curved rocking portion 111 so as to allow for forward and rearward swinging movement.

Figure 16:
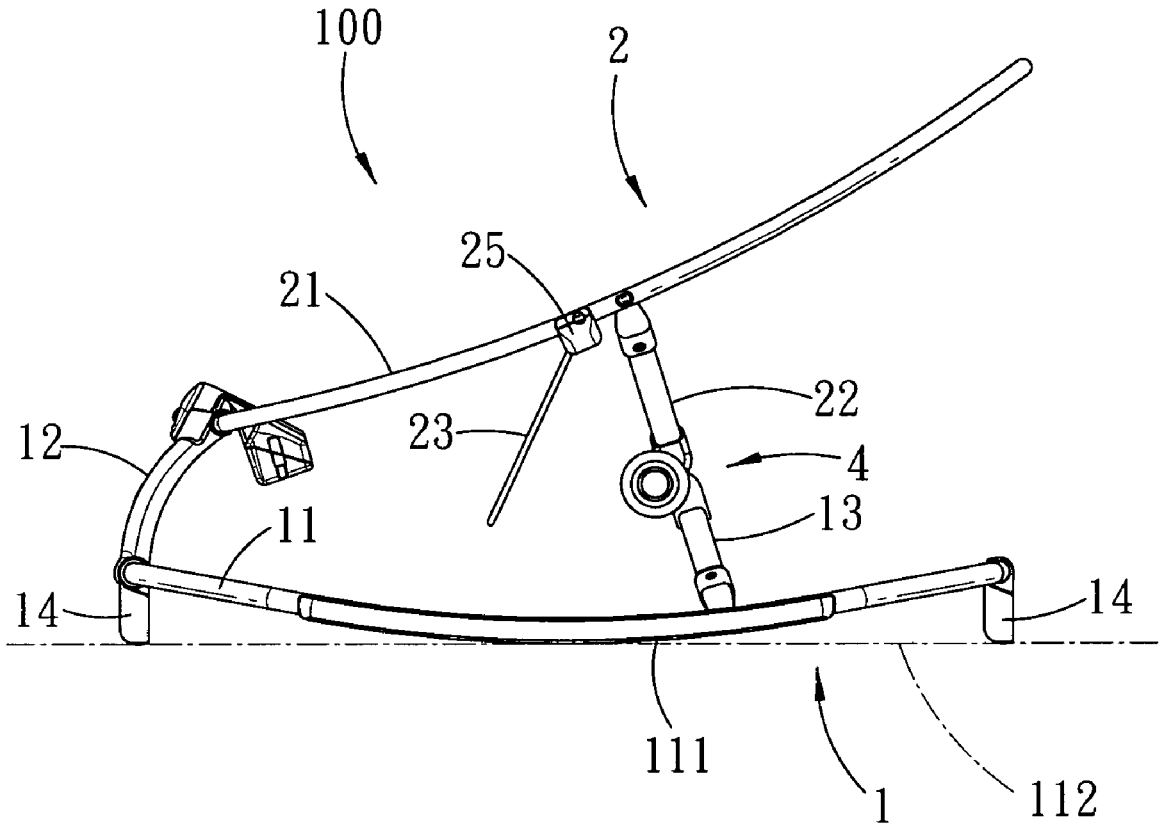
FIG. 16 is a schematic side view of the preferred embodiment in a state, where the rocking chair serves as an ordinary chair.

The anti-slip members 16 are attached respectively to the curved bottom tubes 111, and are disposed on a support surface 112, such as the ground surface. The first support seat 12 is connected between front ends of the curved bottom tubes 11. The second support seat 15 is connected between rear ends of the curved bottom tubs 111. The base 1 further includes two bottom legs 14 connected respectively and pivotally to the first and second support seats 12, 15. The bottom legs 14 are pivotable respectively relative to the first and second support seats 12, 15 to upright positions to thereby allow bottom ends of the bottom legs 14 and bottom ends of the anti-slip members 16 are located on the support surface 112, so that the rocking chair serves as an ordinary chair, as shown in FIG. 16. As such, the rocking motion (i.e., the forward and rearward swinging movement) of the rocking chair 100 can be prevented.

Figure 7:
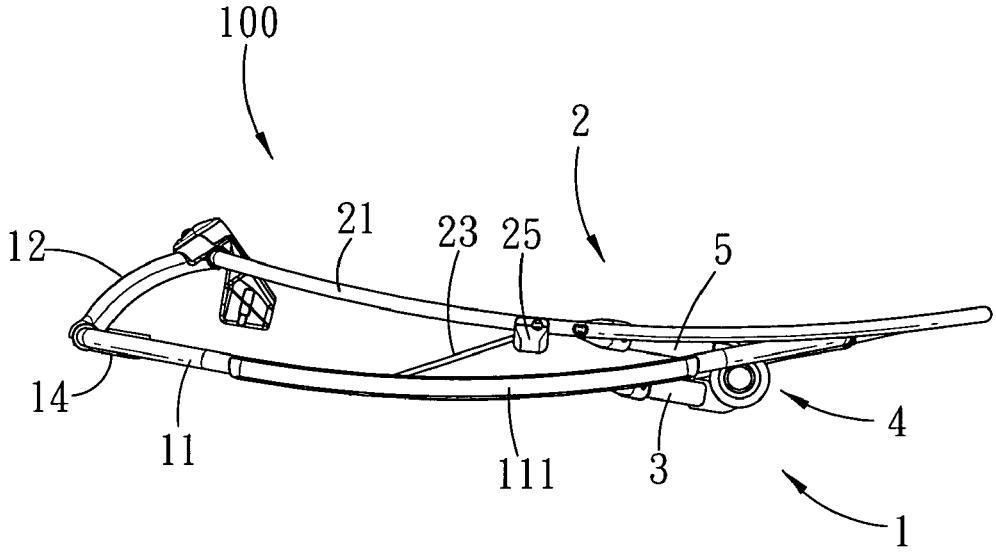
FIG. 7 is a schematic side view of the preferred embodiment, illustrating the seat in a folded position.

The seat 2 includes a looped frame 21, a support rod 23, and two pivot seats 25. In this embodiment, the looped frame 21 is aligned with the curved bottom tubes 11 of the base 1, and is elliptic. The looped frame 21 is disposed pivotally on the first support seat 12 of the base 1, such that the seat 2 is adjustable relative to the base 1 between a fully unfolded position shown in FIG. 5 and a folded position shown in FIG. 7. In the fully unfolded position, a free end of the seat 2 is disposed at an upper limit position, and is spaced apart from the base 1. In the folded position, the free end of the seat 2 is disposed at a lower limit position, and abuts against the base 1.

Figure 8:
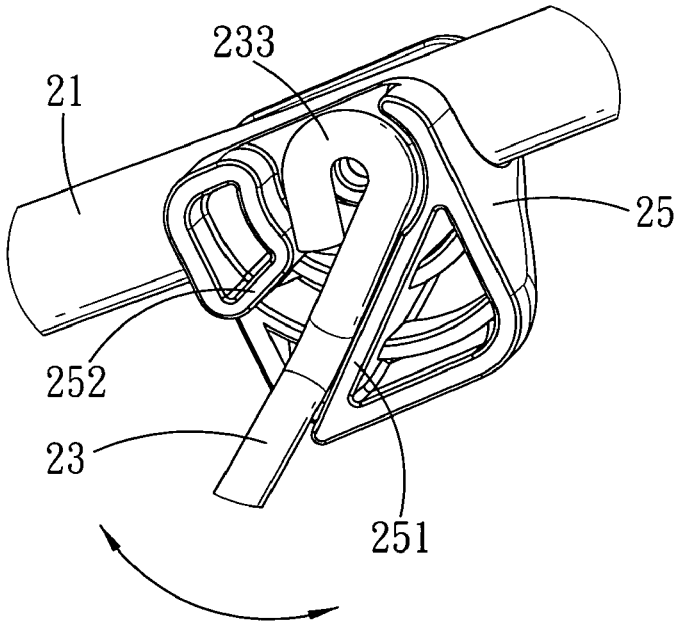
FIG. 8 is a fragmentary perspective view of the preferred embodiment, illustrating the connection relationship between a support rod and a pivot seat of the foldable rocking chair.

The pivot seats 25 are disposed respectively on left and right sides of the looped frame 21. With further reference to FIG. 8, each of the pivot seats 25 has a lower position-limiting portion 251 and an upper position-limiting portion 252. The support rod 23 has a horizontal middle rod portion 231 and two inclined side rod portions 232 extending respectively, upwardly, and outwardly from two opposite ends of the horizontal middle rod portion 231, as shown in FIG. 4. Each of the side rod portions 232 of the support rod 23 has a back-bent upper end 233 connected rotatably to the corresponding pivot seat 25, and is rotatable between the upper and lower position-limiting portions 251, 252. A seat fabric (not shown) has two ends fastened respectively to front and rear sides of the looped frame 21, and is supported by the support rod 23. When the seat 2 is changed between the fully unfolded position and the folded position, the support rod 23 pivots relative to the pivot seats 25. When the seat 2 is disposed at the fully unfolded position, the support rod 23 abuts against the lower position-limiting portions 251 of the pivot seats 25. When the seat 2 is disposed at the folded position, the side rod portions 232 of the support rod 23 abut against the upper position-limiting portions 252 of the pivot seats 25, and the middle rod portion 231 of the support rod 23 is aligned with and disposed between the curved bottom tubes 11.

However, the shapes of the base 1 and the seat 2 are not limited to those described above. For example, the curved bottom tubes 11 may be U-shaped, and the looped frame 21 may be rectangular.

The seat fabric is disposed between the looped frame 21 and the support rod 23 in a known manner for supporting a child seated thereon.

The first adjustment rod 3 is curved, and has two ends connected respectively and pivotally to the curved bottom tubes 11 of the base 1. The second adjustment rod 5 is also curved, and has two ends connected respectively and pivotally to the left and right sides of the looped frame 21 of the seat 2. The first and second adjustment rods 3, 5 are connected to the folding joint 4.

Figure 9:
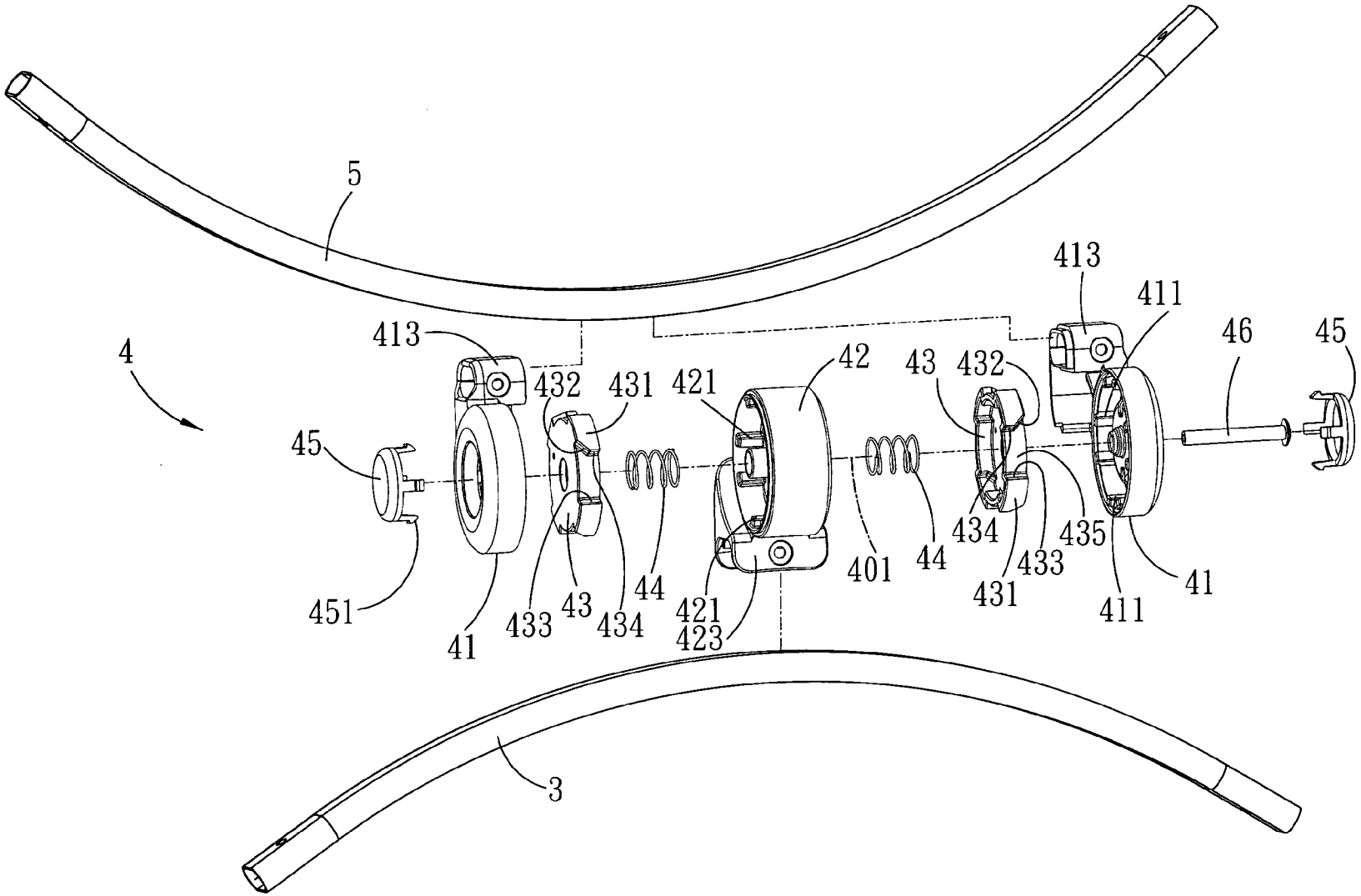
FIG. 9 is an exploded perspective view of a folding joint of the preferred embodiment.
Figure 10:
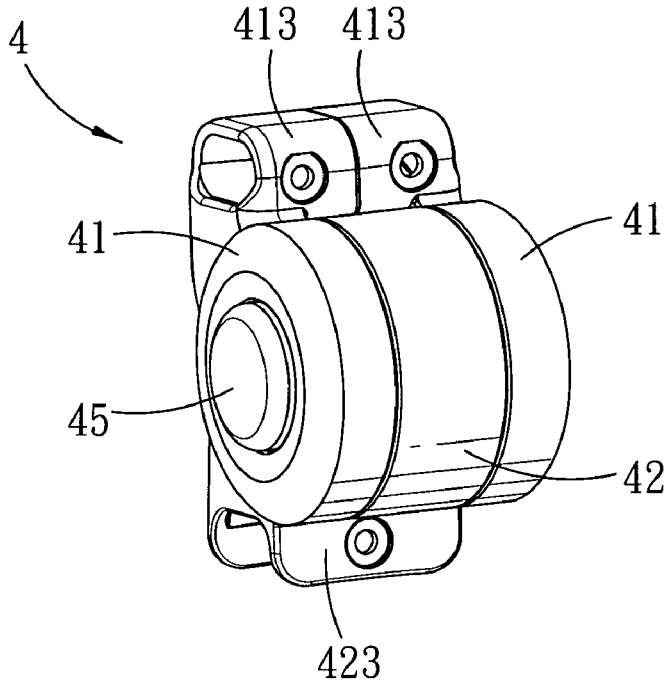
FIG. 10 is an assembled perspective view of the folding joint of the preferred embodiment.
Figure 11:
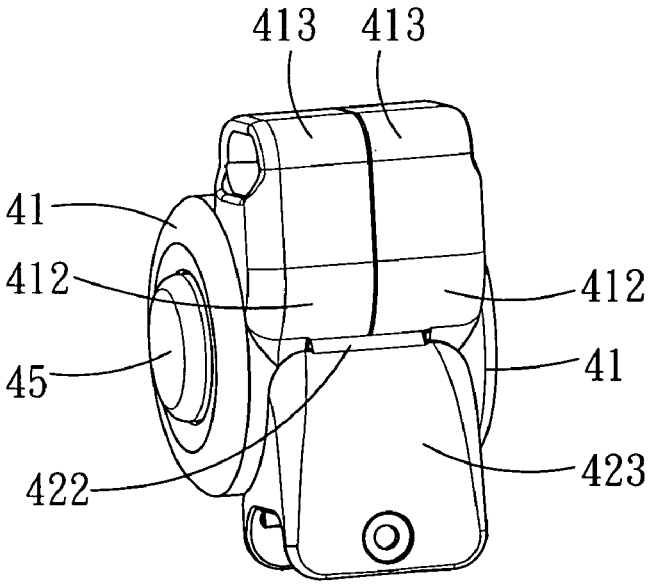
FIG. 11 is an assembled perspective view of the folding joint of the preferred embodiment, viewed at a different angle.

With further reference to FIGS. 9, 10, and 11, the folding joint 4 is disposed between the first and second adjustment rods 3,5, and includes a plurality components. The components are arranged along a rotating axis 401, and includes a first rotating housing 42, two second rotating housings 41, two gears 43, two biasing springs 44, two pushbuttons 45, and a rivet pin 46. The first rotating housing 42 is located at a middle of the folding joint 4. At each side of the first rotating housings 42, a respective one of the biasing spring 44, a respective one of the gears 43, a respective one of the second rotating housings 41, and a respective one of the pushbuttons 45 are disposed in sequence.

The first rotating housing 42 has an outer surface provided with a mounting frame 423 connected to a middle portion of the first adjustment rod 3, and an inner surface formed with a plurality of first rib units each consisting of two adjacent first ribs 421 projecting toward the rotating axis 401. In this embodiment, the first ribs 421 are but not limited to rectangular. The first rotating housing 42 is further formed with a stop rib 422 disposed immediately above the mounting frame 423 and parallel to the rotating axis 401. In this embodiment, the mounting frame 423 of the first rotating housing 42 is disposed on the first adjustment rod 3 by a screw.

Each of the biasing springs 44 is disposed between the first rotating housing 42 and the corresponding gear 43 for biasing the corresponding gear 43 toward the corresponding second rotating housing 41.

Figure 12:
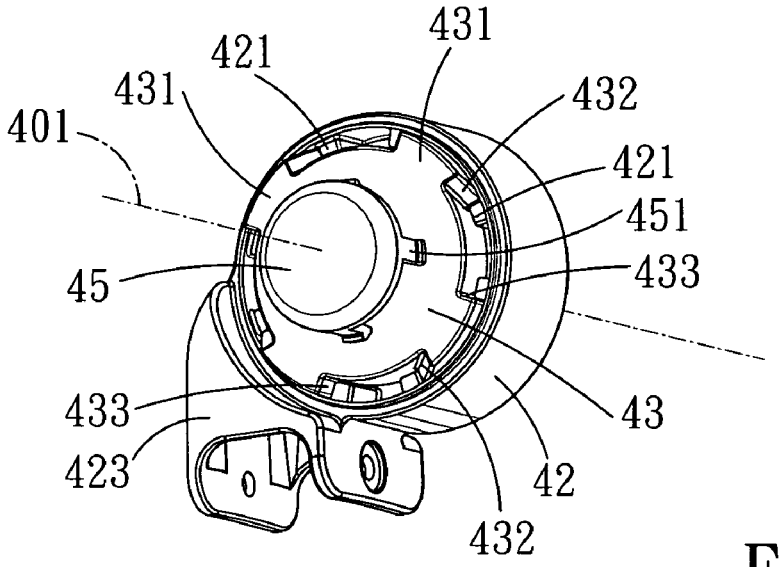
FIG. 12 is an assembled perspective view of the folding joint of the preferred embodiment, illustrating a gear formed with a plurality of projecting teeth each having an inclined surface portion.

With further reference to FIG. 12, each of the gears 43 is disposed between the corresponding second rotating housing 41 and the first rotating housing 42, and has an annular outer peripheral surface formed with a plurality of projecting teeth 431 spaced apart from each other to define a plurality of keyways 435. The keyways 435 in each of the gears 43 engage the first rib units, respectively, so as to prevent rotation of the corresponding gear 43 relative to the first rotating housing 42. Each of the projecting teeth 431 has a flat side surface 433 parallel to the rotating axis 401, and a non-flat side surface opposite to the flat side surface 433 and having an inclined surface portion 432 proximate to the corresponding second rotating housing 41, and an axial surface portion 434 connected to the inclined surface portion 432, parallel to the rotating axis 401, and distal from the corresponding second rotating housing 41. Each of the keyways 435 is defined by the corresponding flat side surface 433 and the corresponding non-flat side surface that has the inclined surface portion 432 and the axial surface portion 434.

Figure 6:
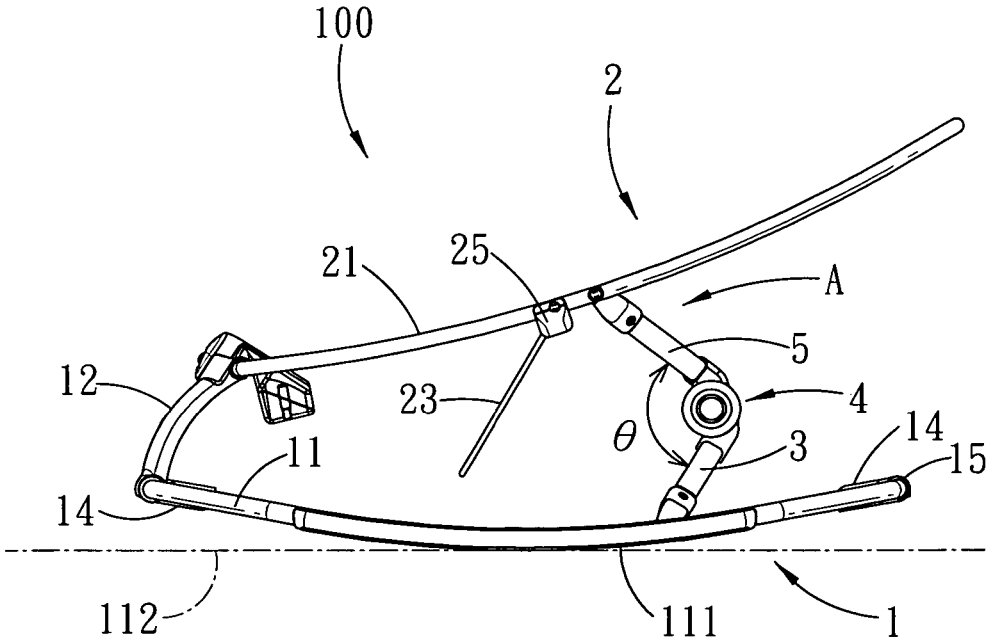
FIG. 6 is a schematic side view of the preferred embodiment, illustrating the seat in a semi-unfolded position.

Each of the second rotating housings 41 is pivotally connected to the first rotating housing 42 along the rotating axis 401, and has an outer surface provided with a mounting frame 413 connected to a middle portion of the second adjustment rod 5, and an inner surface formed with a plurality of second rib units each consisting of two second ribs 411 projecting toward the rotating axis 401. In this embodiment, the second ribs 411 are but not limited to rectangular. The outer surface of each of the second rotating housings 41 has an abutment portion 412 disposed immediately under the mounting frame 413 and pivotable into contact with the stop rib 422 of the first rotating housing 42 so as to limit the rotational angle of the first and second adjustment rods 3, 5 relative to each other within a predetermined range. In other words, the abutment portions 412 of the second rotating housings 41 cooperate with the stop rib 422 of the first rotating housing 42 to limit an angle θ (see FIG. 6) formed between the first and second adjustment rods 3, 5 to be smaller than 180 degrees.

In this embodiment, the mounting frames 413 of the second rotating housing 41 are connected to the second adjustment rod 5 by screws.

Each of the pushbuttons 45 is disposed on a side of the corresponding second rotating housing 41 distal from the corresponding gear 43, and has a plurality of push arms 451 that extend through the corresponding second rotating housing 41 and that are in contact with the corresponding gear 43. The push arms 451 have barbed ends to prevent unintentional removal of the pushbuttons 45 from the second rotating housings 41.

The second rotating housings 41, the first rotating housing 42, the gears 43, and the biasing springs 44 are interconnected by the rivet pin 46, such that the rivet pin 46 extends along the rotating axis 401.

Figure 13:
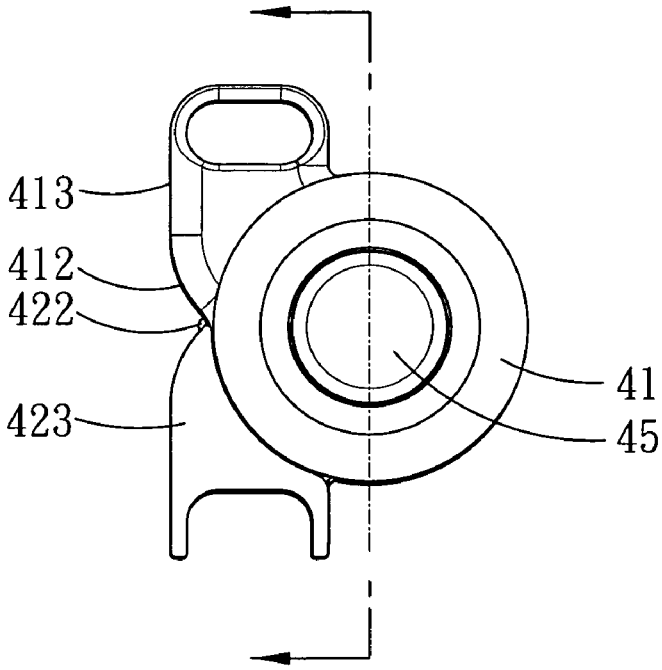
FIG. 13 is a schematic side view of the folding joint of the preferred embodiment.
Figure 14:
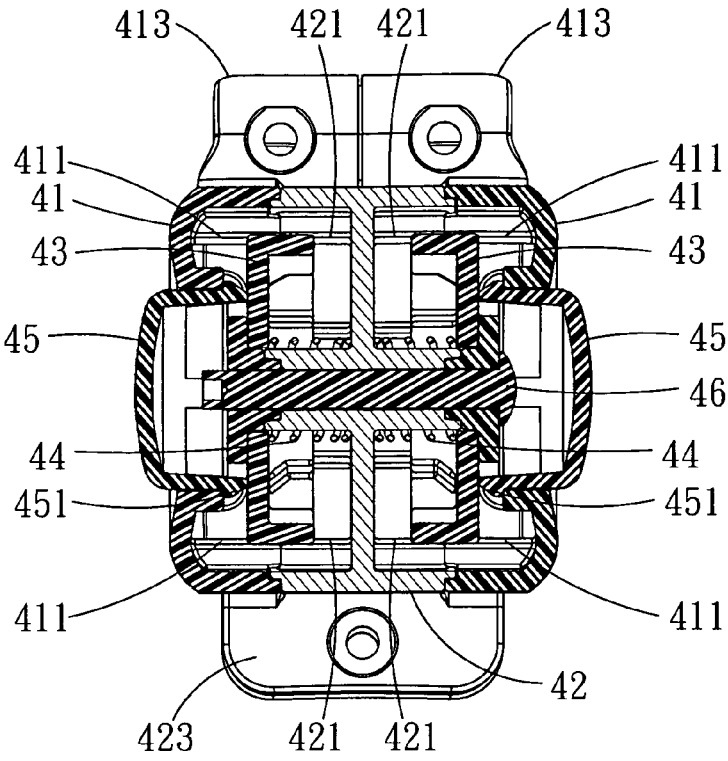
FIG. 14 is a sectional view of the folding joint of the preferred embodiment in a normal state.

With further reference to FIGS. 13 and 14, when in use (i.e., the child is seated on the seat 2, and the seat 2 is disposed at the fully unfolded position), since each of the gears 43 is biased toward the corresponding second rotating housing 41 by the corresponding biasing spring 44, it is disposed between the first rotating housing 42 and the corresponding rotating housing 41. As such, the second rib units of the second rotating housings 41 engage respectively the keyways 435 in the gears 43 to thereby lock the second rotating housings 41 relative to the first rotating housing 41. That is, the folding joint 4 is in a normal state.

In this state, since the weight of the child results in pivoting movement of the seat 2 relative to the base, 1 toward the folded position, the flat side surfaces 433 of the gears 43 are in contact with the corresponding second ribs 411 of the second rotating housings 41, respectively, and the axial surface portions 434 of the non-flat side surfaces of each of the gears 43 are in contact with the corresponding first ribs 421 of the first rotating housing 42, respectively. Since the flat side surfaces 433 are parallel to the axial surface portions 434, and since each of the first and second rib units engages the corresponding keyways 435, pivoting movement of the seat 2 toward the folded position can be prevented.

Figure 15:
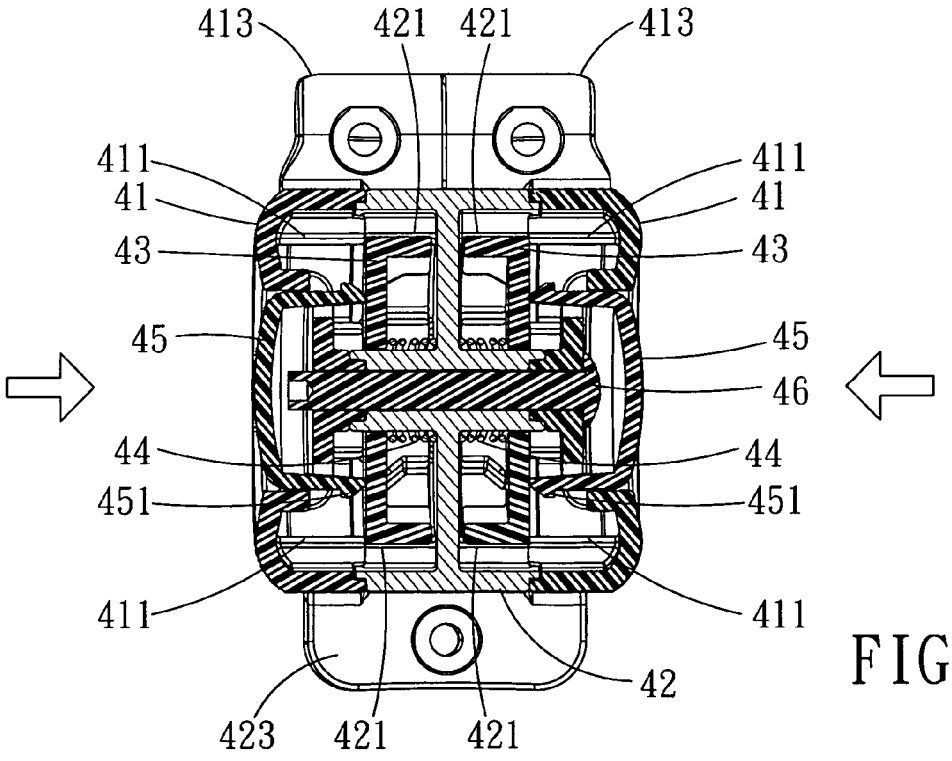
FIG. 15 is a sectional view of the folding joint of the preferred embodiment in an adjustable state.

When it is desired to pivot the seat 2 from the fully unfolded position to the folded position, the pushbuttons 45 are pushed toward each other to remove the gears 43 from the second rotating housings 41, respectively, to thereby disengage the second rib units from the keyways 435, as shown in FIG. 15. Hence, rotation of the first rotating housing 42 relative to the second rotating housings 41 is allowed. That is, the folding joint 4 is in an adjustable state, and the second adjustment rod 5 can be rotated relative to the first adjustment rod 3 in a counterclockwise direction (A) (see FIG. 6). Thus, the seat 2 can be pivoted downwardly relative to the base 1.

When it is desired to pivot the seat 2 from the folded position to the fully unfolded position, the seat 2 is pivoted upwardly relative to the base 1 to thereby rotate the second adjustment rod 5 relative to the first adjustment rod 3 in a clockwise direction. Clockwise rotation of the second adjustment rod 5 relative to the first adjustment rod 3 results in contact between the second rib units and the inclined surface portions 432 of the gears 43. Hence, the second rotating housings 41 rotate relative to the first rotating housing 42 in a direction, so that the second rib units push the inclined surface portions 432 against the biasing actions of the biasing springs 44 to remove the gears 43 from the second rotating housings 41 to thereby allow for further upward pivoting movement of the seat 2 relative to the base 1. Therefore, upward pivoting movement of the seat 2 relative to the base 1 results in operation-free release of the second rotating housings 41 relative to the first rotating housing 42. That is, to pivot the seat 2 from the folded position to the fully unfolded position, operation of the pushbuttons 25 is not required.

The inclined surface portions 432 of the projecting teeth 431 are angularly equidistant. The flat side surfaces 433 of the projecting teeth 431 are also angularly equidistant.

In this embodiment, since each of the first and second rib units consists of two ribs 421, 411, as described above, when the gears 43 are moved into the second rotating housings 41 (e.g., the seat 2 is pivoted to the fully unfolded position), as shown in FIG. 14, two of the first ribs 421 and two of the second ribs 411 are disposed between each adjacent pair of the projecting teeth 431 of the gears 43. Since the number of either the first or second ribs 421, 411 are eight, when any of the projecting teeth 431 moves from one of the two adjacent first ribs 421 (or the two second ribs 411) onto the other of the two adjacent first ribs 421 (or the two second ribs 411), the corresponding second rotating housing 41 rotates relative to the first rotating housing 42 by an angle of 90 degrees. As a consequence, the seat 2 can be locked at a selected one of a plurality of semi-unfolded positions, e.g., the one shown in FIG. 6. When the seat 2 is disposed at the fully unfolded position shown in FIG. 5, the first and second adjustment rods 3, 5 are aligned with each other. When the seat 2 is disposed at the semi-unfolded position shown in FIG. 6, the first and second adjustment rods 3, 5 are perpendicular to each other. When the seat 2 is disposed at the folded position shown in FIG. 7, the first and second adjustment rods 3, 5 are parallel or quasi-parallel to each other.

The number of the projecting teeth 431 and the first and second ribs 421, 411 may be changed. For example, the number of the projecting teeth 431 is increased to eight, the number of the first ribs 421 is increased to sixteen, and the number of the second ribs 411 is increased to sixteen. Alternatively, one of the second rotating housings 41, one of the gears 43, one of the biasing springs 44, and one of the pushbuttons 45 disposed at the same side of the first rotating housing 42 may be omitted.

Figure 17:
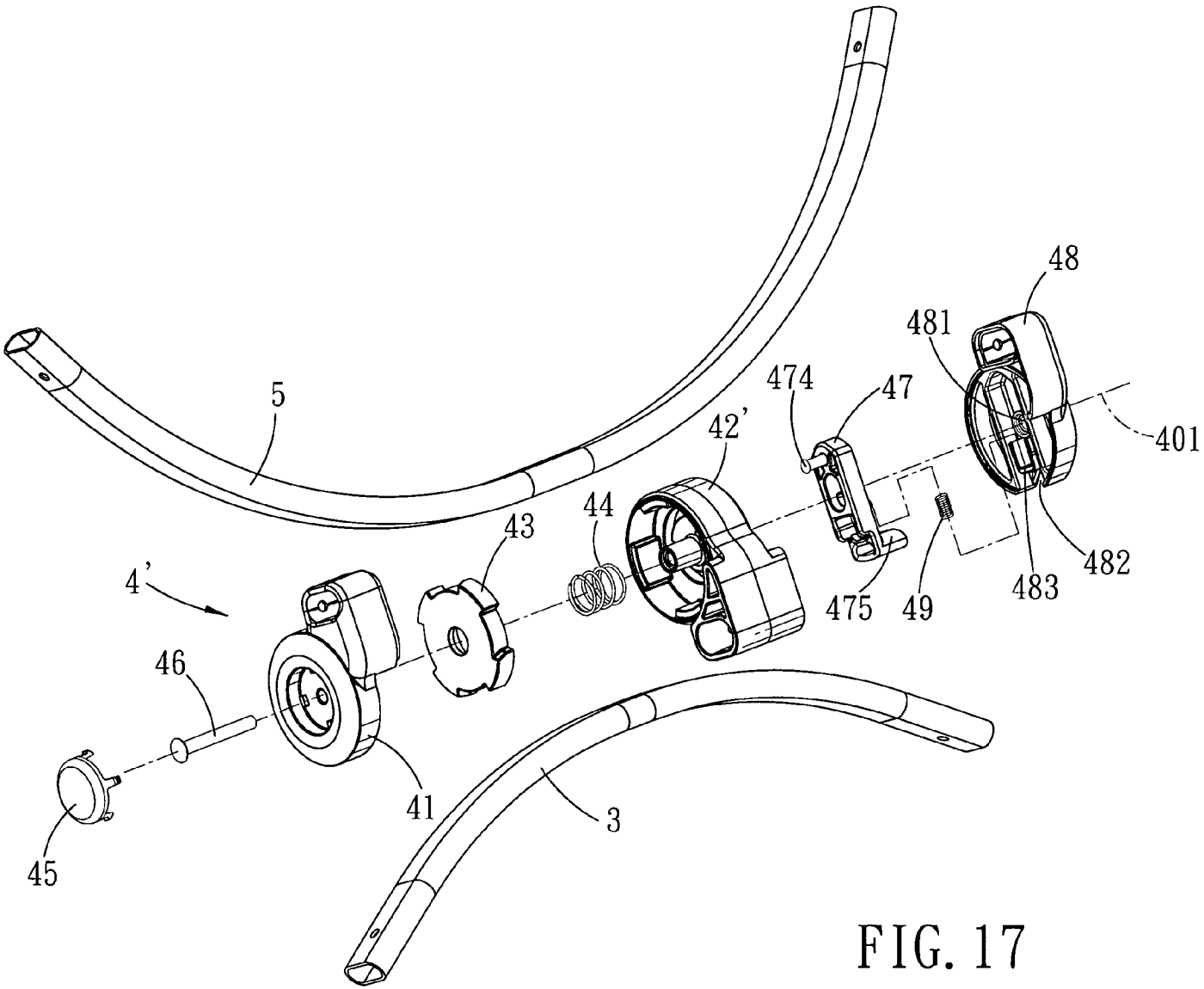
FIG. 17 is an exploded perspective view of a modified folding joint.

FIG. 17 shows a modified folding joint 4' having a safety locking function. The modified folding joint 4' is connected between the first and second adjustment rods 3, 5, and includes a plurality of components arranged along the rotating axis 401 and including a first rotating housing 42', a second rotating housing 41, a gear 43, a biasing spring 44, a pushbutton 45, a rivet pin 46, a safety locking member 47, a third rotating housing 48, and a compression spring 49. Each of the second rotating housing 41, the gear 43, the biasing spring 44, the pushbutton 45, and the rivet pin 46 is similar in construction to that shown in FIG. 9. The first rotating housing 42' is connected to the first adjustment rod 3. The second and third rotating housings 41, 48 are connected to the second adjustment rod 5.

Figure 18:
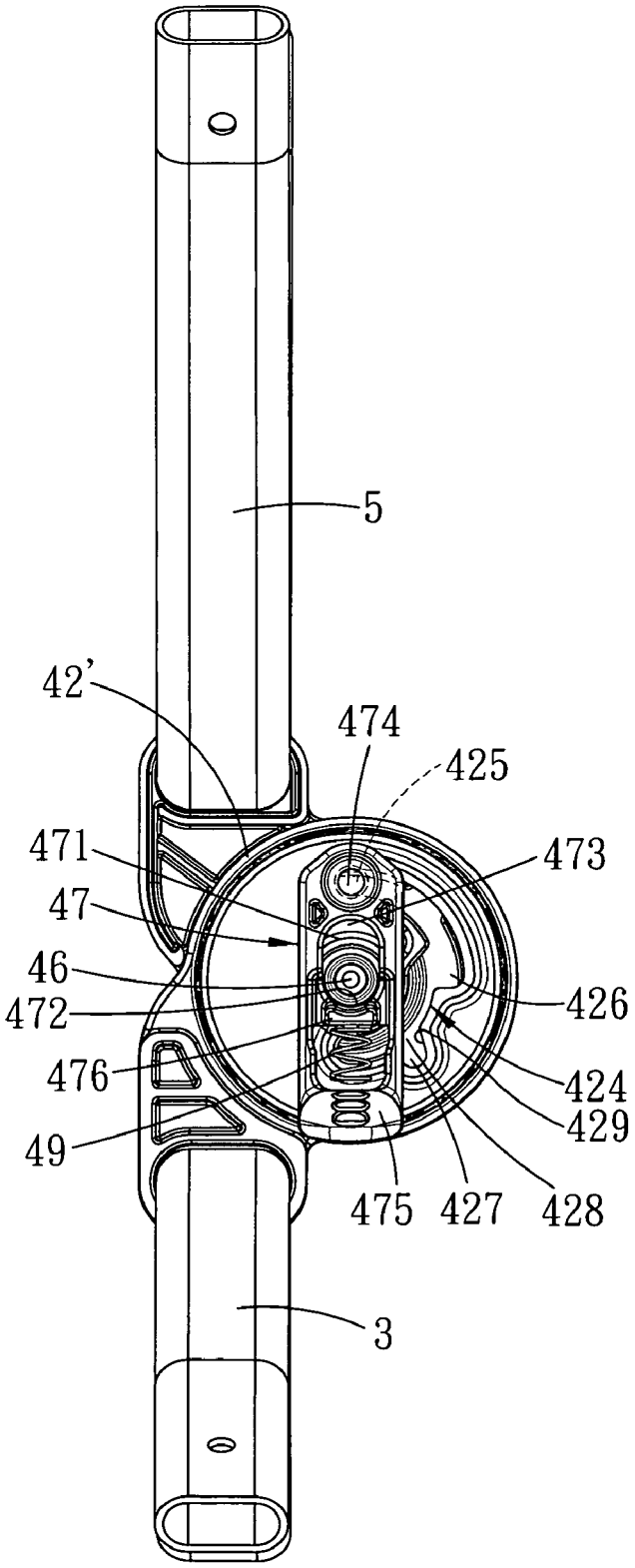
FIG. 18 is a schematic side view of the modified folding joint in a state, where the seat is disposed in a fully unfolded state.
Figure 19:
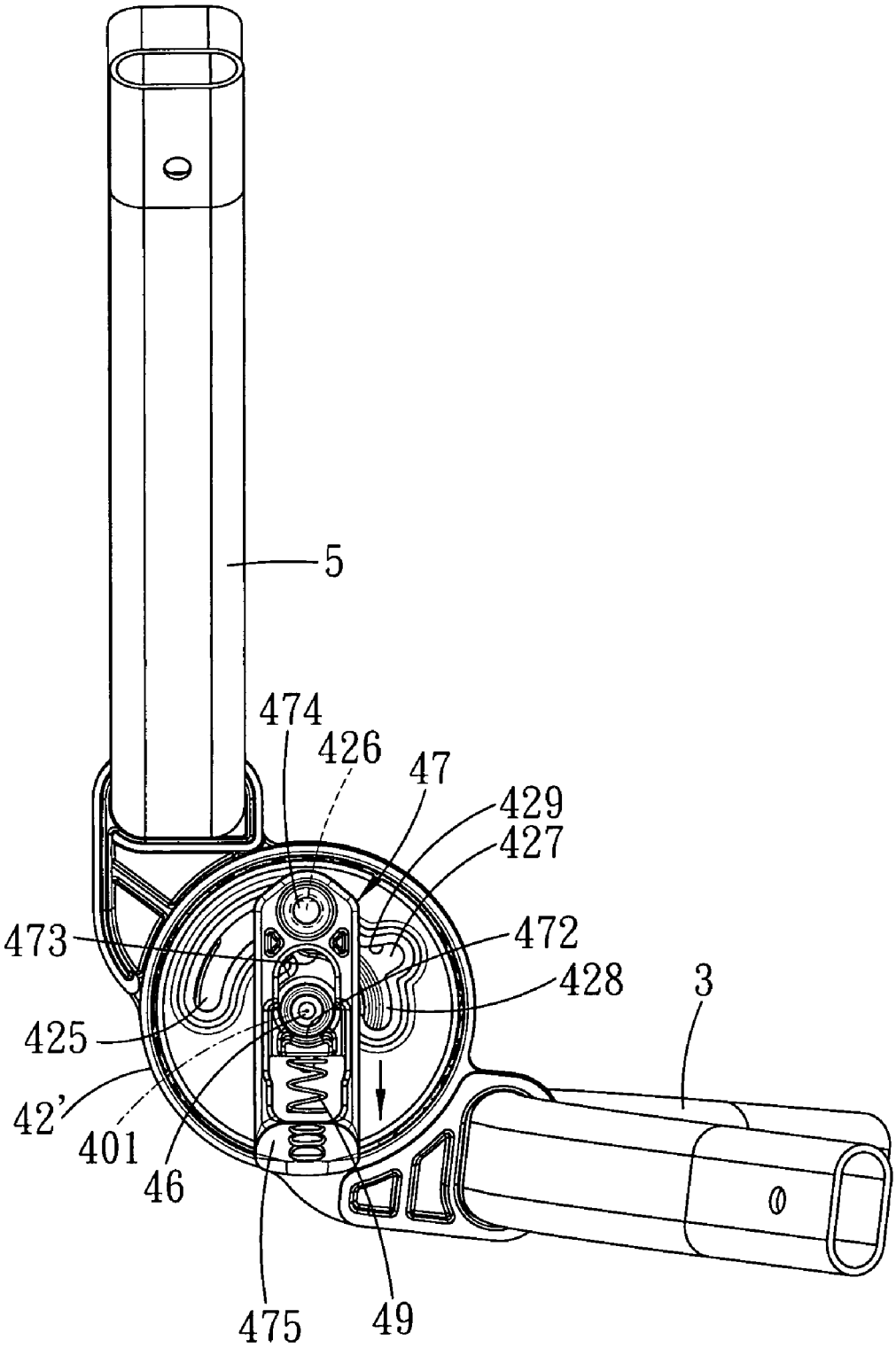
FIG. 19 is a schematic side view of the modified folding joint in a state, where the seat is disposed in a semi-folded state.
Figure 20:
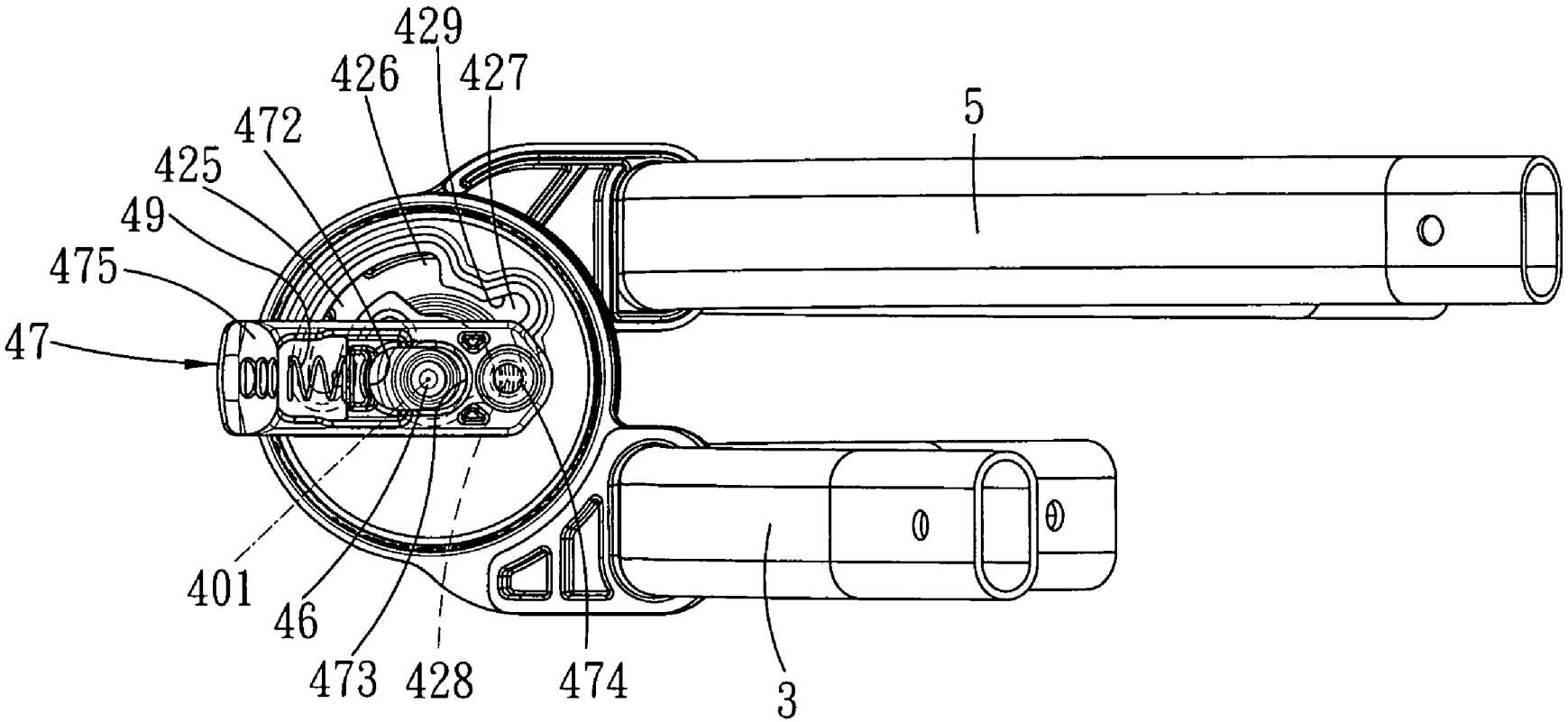
FIG. 20 is a schematic side view of the modified folding joint in a state, where the seat is disposed in a folded state.

With further reference to FIGS. 18, 19, and 20, the compression spring 49 has two ends abutting respectively against the safety locking member 47 and the third rotating housing 48 to provide a pushing force to the safety locking member 47 in a direction perpendicular to the rotating axis 401.

Figure 21:
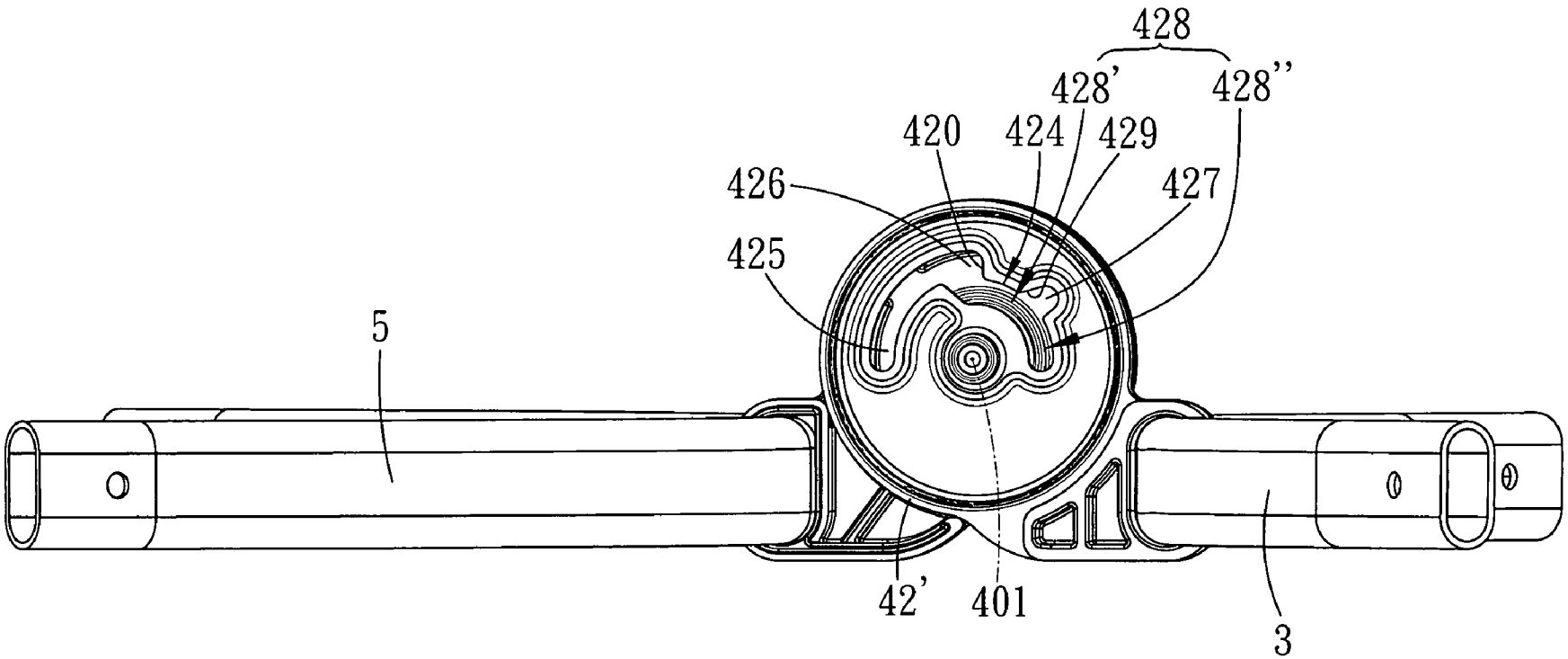
FIG. 21 is a schematic side view of the modified folding joint, a safety locking member being removed for illustrating the shape of a through groove in a first rotating housing.

With further reference to FIG. 21, the first rotating housing 42' is formed with a through groove 424 in a side surface thereof proximate to the third rotating housing 48. The through groove 424 has a first curved groove section 425, a transitional groove section 426, and a second curved groove section 428. Each of the first and second curved groove sections 425, 428 extends along a circumferential direction with respect to the rotating axis 401, and has an open end connected to the transitional groove section 426, and a closed end opposite to the open end. The radial distance between the first curved groove section 425 and the rotating axis 401 is larger than that between the second curved groove section 428 and the rotating axis 401. The transitional groove section 426 is connected between the first and second curved groove sections 425, 428. The through groove 424 further includes a positioning groove section 427 extending radially and outwardly from an intermediate portion of the second curved groove section 428 to divide the second curved groove section 428 into an inner groove portion 428' proximate to the transitional groove section 426, and an outer groove portion 428" distal from the transitional groove section 426.

Figure 22:
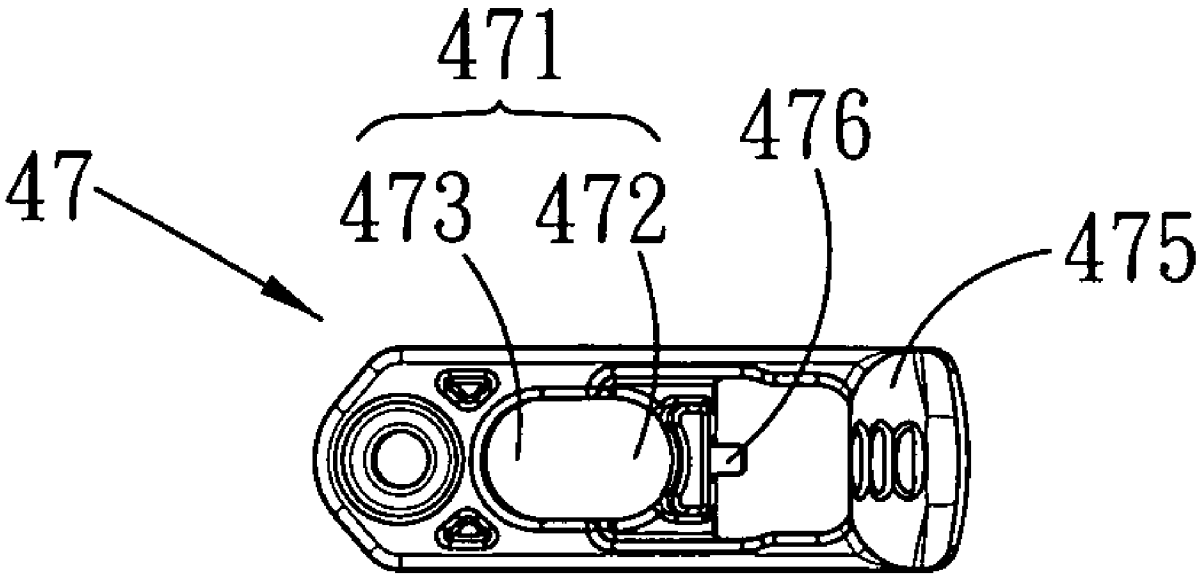
FIG. 22 is a schematic side view of the safety locking member of the modified folding joint.

With further reference to FIG. 22, the safety locking member 47 has an elliptical through hole 471 formed through a central portion thereof. The through hole 471 has a locking end 472 and a release end 473. The rivet pin 46 extends through the through hole 471. As such, the safety locking member 47 is pivotable about and movable relative to the rotating axis 401, such that the rivet pin 46 is movable into the locking end 472 or the release end 473 of the through hole 471 in the safety locking member 47. That is, the safety locking member 47 is changeable relative to the rivet pin 46 between a locking position whereat the rivet pin 46 is disposed at the locking end 472 of the through hole 471, and a release position whereat the rivet pin 46 is disposed at the release end 473 of the through hole 471.

The safety locking member 47 is formed with a guide rod 474 (see FIG. 17) disposed at one end thereof, a handle 475 disposed at the other end thereof, and a stub 476 disposed in proximity to the through hole 471. The guide rod 474 is received movably within the through groove 424 of the first rotating housing 42'.

The third rotating housing 48 is disposed at a side of the first rotating housing 42' distal from the second rotating housing 41, and has a central hole 481 permitting extension of the rivet pin 46 therethrough such that the third rotating housing 48 is sleeved rotatably on the rivet pin 46, a notch 482 formed in an outer periphery of the third rotating housing 48, and a stop block 483 adjacent to the notch 482 and projecting toward the safety locking member 47. The handle 475 of the safety locking member 47 extends through the notch 482 to allow co-rotation of the safety locking member 47 with the third rotating housing 48, and is exposed outwardly of the third rotating housing 48 to allow for manual operation. The compression spring 49 has one end sleeved on the stub 476 of the safety locking member 47, and the other end abutting against the stop block 483 of the third rotating housing 48 for biasing the safety locking member 47 toward the locking position to move the rivet pin 46 toward the locking end 472 of the through hole 471. In this embodiment, the stop block 483 is but not limited to U-shaped.

When the seat 2 is disposed at the fully unfolded position so that the first and second adjustment rods 3, 5 are aligned with each other, as shown in FIG. 18, the guide rod 474 of the safety locking member 47 is disposed in the first curved groove section 425, and the rivet pin 46 is biased by the compression spring 49 into the locking end 472 of the through hole 471.

When the seat 2 is pivoted relative to the base 1 from the fully unfolded position toward the folded position, the guide rod 474 moves from the first curved groove section 425 into the transitional groove section 426. Once the guide rod 474 comes into contact with a wall 420 of the first rotating housing 42' defining a side of the transitional groove section 426, as shown in FIG. 19, since the wall 420 extends in a generally radial direction with respect to the rotating axis 401, further pivoting movement of the seat 2 toward the folded position is prevented. That is, if the pushbutton 45 is pressed unintentionally, or if the seat 2 is adjusted from the fully unfolded position toward the folded position such that the child is seated on the seat 2, the seat 2 cannot be pivoted to the folded position directly so that damage to the child can be prevented.

To continue to pivot the seat 2 toward the folded position, the handle 475 can be pulled in a direction shown by the arrow in FIG. 19 against the biasing action of the compression spring 49 to move the rivet pin 46 from the locking end 472 into the release end 473, so that the guide rod 474 moves along the wall 420. After the guide rod 474 moves past a radial inner end of the wall 420, it moves into the open end of the second curved groove section 428. When the guide rod 474 moves into the closed end of the second curved groove section 428, as shown in FIG. 20, the seat 2 is pivoted to the folded position.

Preferably, the through hole 424 further has a positioning groove section 427 extending radially and outwardly from an intermediate portion of the second curved groove section 428. During movement of the guide rod 474 from the open end of the second curved groove section 428 into the closed end of the second curved groove section 428, when the guide rod 474 moves to a position aligned with the positioning groove section 427, it is biased by the compression spring 49 into the positioning groove section 427 to prevent further pivoting movement of the seat 2 toward the folded position, so that the second adjustment rod 5 is at a predetermined inclination angle relative to the first adjustment rod 3. The number of the positioning groove section 427 may be increased such that the angle formed between the first and second adjustment rods 3, 5 can be adjusted.

Preferably, the first rotating housing 42' has a guiding wall surface 429 disposed at a junction between the positioning groove section 427 and the inner groove portion 428' of the second curved groove section 428. When the seat 2 is pivoted from the folded position to the fully unfolded position, the guiding wall surface 429 guides the guide rod 474 from the positioning groove portion 427 into the inner groove portion 428' of the second curved groove section 428. Hence, the guide rod 474 can move from the second curved groove section 428 into the transitional groove section 426 and, thus, the first curved groove section 425, such that additional operation of the safety locking member 47 is not necessary. When the seat 2 is pivoted from the fully unfolded position toward the folded position, due to the biasing action of the compression spring 49, the guide rod 474 can be moved into the positioning groove section 427, thereby allowing for formation of the predetermined inclination angle between the first and second adjustment rods 3, 5. Besides, accidental folding and damage caused to infant due to the accidental folding can be effectively prevented. As such, movement of the guide rod 474 from the positioning groove section 427 into the inner groove section 428' is allowed when the seat 2 is pivoted from the folded position to the fully unfolded position, and movement of the guide rod 474 from the positioning groove section 427 into the outer groove section 428" is prevented when the seat 2 is pivoted from the fully unfolded position to the folded position position.

Due to the specific shape of the through hole 424 and configuration of the gear 43, when the seat 2 is pivoted from the folded position to the fully unfolded position, operation of the pushbutton 45 and the handle 475 is not necessary. Furthermore, although operation of the pushbutton 45 and the handle 475 is required for pivoting movement of the seat 2 from the fully unfolded position to the folded position, since the pushbutton 45 is adjacent to the handle 475, the rocking chair of this invention is convenient to operate. Thus, the object of this invention is achieved.

With this invention thus explained, it is apparent that numerous modifications and variations can be made without departing from the scope and spirit of this invention. It is therefore intended that this invention be limited only as indicated by the appended claims.

I claim:

1. A foldable rocking chair comprising:

a base having a curved rocking portion;

a first adjustment rod pivotally connected to said base;

a seat having a front end pivotally connected to a front end of said base;

a second adjustment rod pivotally connected to said seat; and a folding joint for interconnecting said first and second adjustment rods, such that said seat is adjustable relative to said base between a fully unfolded position and a folded position, said folding joint being constructed so as to allow pivoting movement of said seat from said folded position to said fully unfolded position, while preventing pivoting movement of said seat from said fully unfolded position to said folded position.

2. The foldable rocking chair as claimed in claim 1, wherein said folding joint includes:

a first rotating housing connected to said first adjustment rod and having an inner surface formed with a plurality of first rib units projecting toward said rotating axis;

a second rotating housing connected to said second adjustment rod and having an inner surface formed with a plurality of second rib units projecting toward said rotating axis;

a gear disposed between said first and second rotating housings and having an annular outer peripheral surface formed with a plurality of projecting teeth spaced apart from each other to define a plurality of keyways, said first rib units engaging said keyways, respectively, so as to prevent rotation of said gear relative to said first rotating housing; and a biasing spring disposed between said first rotating housing and said gear so as to bias said gear toward said second rotating housing to thereby engage said second rib units with said keyways, respectively, thus locking said first and second rotating housings relative to each other;

said first rotating housing, said second rotating housing, said gear, and said biasing spring being assembled along a rotating axis.

3. The foldable rocking chair as claimed in claim 2, wherein one of said first and second rotating housings is formed with a stop rib, and the other of said first and second rotating housings has an abutment portion pivotable into contact with said stop rib so as to limit a rotational angle of said first and second adjustment rods relative to each other within a predetermined range.

4. The foldable rocking chair as claimed in claim 2, wherein said folding joint further includes a third rotating housing and a safety locking member, said third rotating housing being disposed at a side of said first rotating housing distal from said second rotating housing, said safety locking member being disposed between said first and third rotating housings, said safety locking member and said third rotating housing being sleeved rotatably on said rivet pin, said safety locking member being movable radially relative to said rivet pin to allow said safety locking member to change relative to said rivet pin between a locking position whereat pivoting movement of said seat relative to said base to said folded position is prevented, and a release position whereat the pivoting movement of said seat relative to said base to said folded position is allowed.

5. The foldable rocking chair as claimed in claim 4, wherein said folding joint further includes a compression spring abutting against and disposed between said third rotating housing and said safety locking member, said safety locking member having a through hole formed through a central portion thereof, said through hole having a locking end and a release end, said rivet pin extending through said through hole, said compression spring providing a pushing force for biasing said safety locking member toward said locking position so as to move said safety locking member such that said rivet pin is disposed within said locking end of said through hole.

6. The foldable rocking chair as claimed in claim 5, wherein said first rotating housing is formed with a through groove in a side surface thereof proximate to said third rotating housing, and said safety locking member is formed with a guide rod disposed within said through groove.

7. The foldable rocking chair as claimed in claim 6, wherein said through groove has a first curved groove section and a second curved groove section, each of which extends along a circumferential direction with respect to said rotating axis, a radial distance between said first curved groove section and said rotating axis being larger than that between said second curved groove section and said rotating axis, said safety locking member being disposed at said locking position when said guide rod is disposed in said first curved groove section, said safety locking member being disposed at said release position when said guide rod is disposed in said second curved groove section.

8. The foldable rocking chair as claimed in claim 7, wherein said through groove further has a transitional groove section connected between said first and second curved groove sections such that, when disposed in said transitional groove section, said guide rod is movable into a selected one of said first and second curved groove sections.

9. The foldable rocking chair as claimed in claim 8, wherein said through groove further has a positioning groove section extending radially and outwardly from an intermediate portion of said second curved groove section such that, when said guide rod is disposed in said positioning groove section, the pivoting movement of said seat from said fully unfolded position to said folded position is prevented.

10. The foldable rocking chair as claimed in claim 9, wherein said first rotating housing has a guiding wall surface disposed at a junction between said positioning groove section and said second curved groove section for guiding said guide rod to move from said positioning groove section into said first curved groove section.

11. The foldable rocking chair as claimed in claim 2, wherein each of said projecting teeth is formed with an inclined surface proximate to said second rotating housing such that, when said seat is pivoted from said folded position to said fully unfolded position, said second rotating housing rotates relative to said first rotating housing in a direction, so that said second rib units contact said inclined surfaces and push said gear toward said first rotating housing to disengage said gear from said second rotating housing, thereby allowing for further rotation of said second rotating housing relative to said first rotating housing in the direction.

12. The foldable rocking chair as claimed in claim 2, wherein said projecting teeth are angularly equidistant.

13. The foldable rocking chair as claimed in claim 2, wherein said folding joint further includes a rivet pin extending through said gear and said first and second rotating housings along said rotating axis.

14. The foldable rocking chair as claimed in claim 2, wherein said folding joint further includes a pushbutton mounted on a side of said second rotating housing distal from said gear and formed with a plurality of push arms that extend through said second rotating housing and that are in contact with said gear.

15. The foldable rocking chair as claimed in claim 1, wherein said folding joint includes a plurality of components interconnected and arranged along a rotating axis and including:

a first rotating housing connected to said first adjustment rod and having an inner surface formed with a plurality of first rib units projecting toward said rotating axis;

two second rotating housings connected to said second adjustment rod and each having an inner surface formed with a plurality of second rib units projecting toward said rotating axis, said first rotating housing being located between said second rotating housings;

two gears flanking said first rotating housing, each of said gears being disposed between said first rotating housing and a corresponding one of said second rotating housings and having an annular outer peripheral surface formed with a plurality of projecting teeth spaced apart from each other to define a plurality of keyways, said first rib units of said first rotating housing engaging said keyways, respectively, so as to prevent rotation of said gears relative to said first rotating housings; and two biasing springs flanking said first rotating housing, each of said biasing springs being disposed between said first rotating housing and a corresponding one of said gears so as to bias the corresponding one of said gears toward a corresponding one of said second rotating housings to thereby engage said second rib units of the corresponding one of said second rotating housings with said keyways, respectively, thus locking said second rotating housings relative to said first rotating housing.

16. The foldable rocking chair as claimed in claim 1, wherein said first rib units are angularly equidistant, and said second rib units are angularly equidistant.

17. The foldable rocking chair as claimed in claim 1, wherein said first and second adjustment rods are configured as curved rods, said folding joint being disposed between middle portions of said first and second adjustment rods.

18. The foldable rocking chair as claimed in claim 1, wherein each of said base and said seat has a looped structure.

19. The foldable rocking chair as claimed in claim 18, wherein said base includes two curved bottom tubes each having opposite front and rear ends, a first support seat connected between said front ends of said curved bottom tubes, and a second support seat connected between said rear ends of said curved bottom tubes, said first adjustment rod having two ends connected respectively and pivotally to said curved bottom tubes, said seat including a looped frame disposed pivotally on said first support seat, said second adjustment rod having two ends connected respectively and pivotally to two opposite sides of said looped frame.

20. The foldable rocking chair as claimed in claim 19, wherein said base further includes two anti-slip members attached respectively to said curved bottom tubes and adapted to be disposed on a support surface.

21. The foldable rocking chair as claimed in claim 20, wherein said base further includes two bottom legs connected respectively and pivotally to said first and second support seats and pivotable respectively relative to said first and second support seats to allow bottom ends of said bottom legs and bottom ends of said anti-slip members to be located on the support surface.

22. The foldable rocking chair as claimed in claim 1, wherein said folding joint is operable to allow for rotation of said first and second rotating housings relative to each other.

* * * * *